US008616672B2

(12) United States Patent
Tatsumi

(10) Patent No.: US 8,616,672 B2
(45) Date of Patent: Dec. 31, 2013

(54) INK-JET RECORDING APPARATUS

(75) Inventor: Shingo Tatsumi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 440 days.

(21) Appl. No.: 13/091,014

(22) Filed: Apr. 20, 2011

(65) Prior Publication Data

US 2011/0261104 A1 Oct. 27, 2011

(30) Foreign Application Priority Data

Apr. 23, 2010 (JP) ..... 2010-100043

(51) Int. Cl.

| | |
|---|---|
| ***B41J 29/38*** | (2006.01) |
| ***B41J 2/38*** | (2006.01) |
| ***B41J 2/045*** | (2006.01) |
| *B41J 2/165* | (2006.01) |

(52) U.S. Cl.

CPC ..... *B41J 2/38* (2013.01); *B41J 2/04528* (2013.01)

USPC ..... 347/17; 347/5; 347/14; 347/23

(58) Field of Classification Search

USPC ..... 347/5, 14, 17, 23

See application file for complete search history.

(56) References Cited

U.S. PATENT DOCUMENTS

| | | | | |
|---|---|---|---|---|
| 4,899,180 | A * | 2/1990 | Elhatem et al. | 347/59 |
| 5,175,565 | A * | 12/1992 | Ishinaga et al. | 347/67 |
| 5,880,751 | A * | 3/1999 | Nishikori et al. | 347/14 |
| 6,086,180 | A * | 7/2000 | Sugimoto et al. | 347/14 |
| 6,322,189 | B1 * | 11/2001 | Anderson et al. | 347/17 |
| 8,240,804 | B2 * | 8/2012 | Tanaka et al. | 347/17 |

FOREIGN PATENT DOCUMENTS

JP 04-250054 A 9/1992

* cited by examiner

*Primary Examiner* — Laura Martin
*Assistant Examiner* — Jeremy Bishop
(74) *Attorney, Agent, or Firm* — Canon USA, Inc., IP Division

(57) ABSTRACT

A recording apparatus includes: a recording head; a temperature detection unit; a first heating element configured to maintain a temperature of the recording head and a second heating element configured to discharge the ink; an acquisition unit configured to acquire at a plurality of predetermined intervals the temperature detected by the temperature detection unit; a first averaging unit configured to obtain an average temperature based on the temperatures acquired by the acquisition unit in a first period; a first drive unit configured to drive the first heating element based on the average temperature obtained by the first averaging unit; a second averaging unit configured to obtain an average temperature based on the temperatures acquired by the acquisition unit in a second period and longer than the first period; and a second drive unit configured to drive the second heating element based on the average temperature obtained by the second averaging unit.

4 Claims, 8 Drawing Sheets

INK-JET RECORDING APPARATUS

BACKGROUND OF THE INVENTION

1. Field of the Invention

The present invention relates to an ink-jet recording apparatus.

2. Description of the Related Art

Japanese Patent Application Laid-Open No. 04-250054 discusses a method for controlling a sub heater included in an ink-jet recording head. An ink-jet recording apparatus discussed in Japanese Patent Application Laid-Open No. 04-250054 preheats an ink discharge silicone chip and ink in the vicinity of a discharge port by using a sub heater which is different from a main heater for discharging ink, thus stabilizing the ink discharge characteristics.

However, with the ink-jet recording apparatus discussed in Japanese Patent Application Laid-Open No. 04-250054, the temperature error from the target temperature Tav is large.

SUMMARY OF THE INVENTION

A recording apparatus according to the present invention includes: a recording head configured to discharge ink; a temperature detection unit configured to detect a temperature of the recording head; a first heating element configured to maintain the temperature of the recording head and a second heating element configured to discharge the ink, disposed at the recording head; an acquisition unit configured to acquire at a plurality of predetermined intervals the temperature detected by the temperature detection unit; a first averaging unit configured to obtain an average temperature based on the temperatures acquired by the acquisition unit in a first period; a first drive unit configured to drive the first heating element based on the average temperature obtained by the first averaging unit; a second averaging unit configured to obtain an average temperature based on the temperatures acquired by the acquisition unit in a second period including the first period and longer than the first period; and a second drive unit configured to drive the second heating element based on the average temperature obtained by the second averaging unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 8:
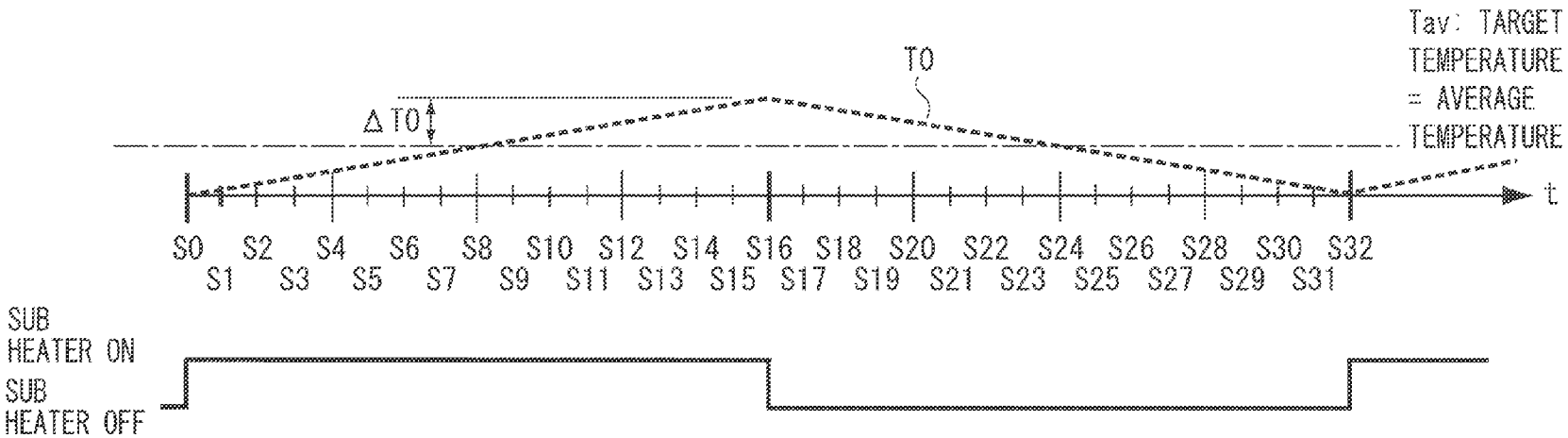
FIG. 8 illustrates a relation between an actual temperature and a target temperature of a recording head.

FIG. 8 illustrates a relation between an actual temperature and a target temperature of the recording head in the equilibrium state achieved by the operation of the sub heater. Referring to FIG. 8, each time the temperature is measured 16 times, the ink-jet recording apparatus averages results of the 16 temperature measurements to acquire an average temperature. Further, the characteristics of temperature rise at the recording head heated by the sub heater are assumed to be symmetrical to the characteristics of temperature fall at the recording head caused by radiating heat from the sub heater. FIG. 8 illustrate a scale Sn (n=0, 1, . . . ), an actual temperature T0 of the recording head, a control signal for turning the sub heater ON and OFF, and a target temperature Tav of the recording head (dotted line). The scale Sn (n=0, 1, . . . ) illustrates sampling timings of temperature measurement.

Referring to FIG. 8, at a timing S0, since the temperature T0 is detected to be lower than the target temperature Tav, the sub heater is turned ON and therefore the temperature T0 begins to rise. At a timing S16, an average temperature for measurement results at timings S1 to S16 is determined and acquired. At this timing, since the average temperature is detected to be equal to or higher than the target temperature Tav (an average value in the equilibrium state), the sub heater is turned OFF. When the sub heater is turned OFF, the temperature T0 begins to fall according to the heat radiation characteristics of the recording head. At a timing S32, an average temperature for measurement results at timings S17 to S32 is determined and acquired. At this timing, since the average temperature is detected to be lower than the target temperature Tav, the sub heater is turned ON.

As the sub heater is repetitively turned ON (heated) and OFF (heat-radiated) in this way, the equilibrium state of the recording head temperature is achieved. In the equilibrium state, a temperature error between the target temperature Tav and the temperature T0 is maximized ΔT0 each time the average temperature is acquired.

Figure 1:
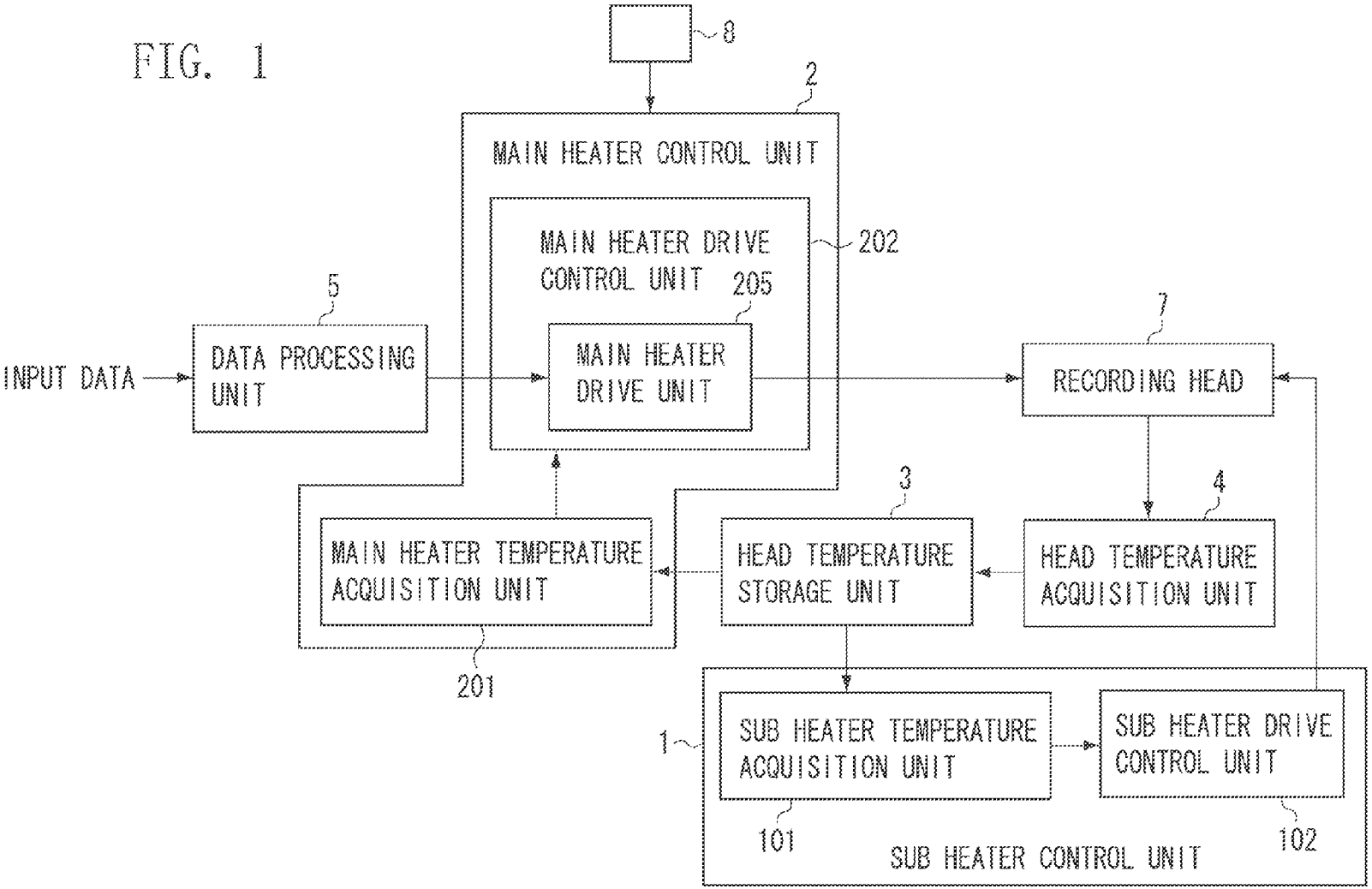
FIG. 1 is a control block diagram illustrating an ink-jet recording apparatus according to a first exemplary embodiment.

FIG. 1 is a control block diagram illustrating an exemplary configuration of an ink-jet recording apparatus according to a first exemplary embodiment of the present invention.

The ink-jet recording apparatus records an image on a recording medium by using a line-head type recording head (thermal ink jet) 7. The ink-jet recording apparatus includes a sub heater control unit 1, a main heater control unit 2, a head temperature storage unit 3, a head temperature acquisition unit 4, a data processing unit 5, and a reference signal generation unit 8. These blocks are included in a central processing unit (CPU) or an application specific integrated circuit (ASIC). A part of these blocks may be included in the recording head 7. Although the CPU or ASIC controls a conveyance method and communication with external devices, descriptions will be omitted.

The data processing unit 5 receives print data input from an external device such as a personal computer (PC) (not illustrated). Upon reception of the print data, the data processing unit 5 generates recording data from the print data. The data processing unit 5 outputs the recording data to the main heater control unit 2 including a main heater drive unit 205.

The main heater drive unit 205 is a second drive unit for driving a main heater 711 (FIG. 1). The main heater control unit 2 inputs the recording data from the data processing unit 5 and a timing signal from the reference signal generation unit 8, and controls the main heater drive unit 205. The main heater drive unit 205 receives from a main heater temperature acquisition unit 201 second average temperature information indicating a temperature used for driving the recording head 7 (hereinafter referred to as second average temperature) to discharge ink. Upon reception of the second average temperature information and the recording data, the main heater control unit 2 controls the main heater drive unit 205 based on the second average temperature information and the recording data. The main heater control unit 2 controls, for example, the pulse width of a generated drive signal. The main heater control unit 2 inputs the second average temperature information in a certain cycle. The main heater drive unit 205 outputs the generated drive signal to the recording head 7. The main heater control unit 2 controls the order of driving a plurality of main heaters 711 corresponding to a plurality of nozzles, and controls time-division driving of the plurality of main heaters 711.

The recording head 7 inputs the drive signal output from the main heater drive unit 205. The main heater 711 is driven by the drive signal to discharge ink to a recording medium (print sheet).

The head temperature acquisition unit 4 acquires temperature information from temperature sensors included in the recording head 7 at predetermined cycles (hereinafter referred to as "sampling cycle"). Each time the recording head temperature acquisition unit 4 acquires temperature information from the temperature sensor at sampling cycles, the recording head temperature acquisition unit 4 outputs the temperature information to the head temperature storage unit 3. The head temperature acquisition unit 4 outputs a timing signal for acquiring temperature information.

The head temperature storage unit 3 stores a predetermined number of pieces of temperature information. The head temperature storage unit 3 stores each of the predetermined number of pieces of temperature information for a fixed time period (hereinafter referred to as second period). The head temperature storage unit 3 sequentially stores the temperature information (input data) input from the recording head temperature acquisition unit 4 at sampling cycles. The head temperature storage unit 3 uses a data moving method for the moving average. Exemplary methods for moving data include a method for using so-called a shift register and a method for sequentially changing the address by using a memory.

The reference signal generation unit 8 generates a timing signal according to the conveyance of a print sheet or the operation of the conveyance method. This timing signal is transmitted to the control unit of the ink-jet recording apparatus, to be used to control the conveyance unit and the recording head.

Figure 2:
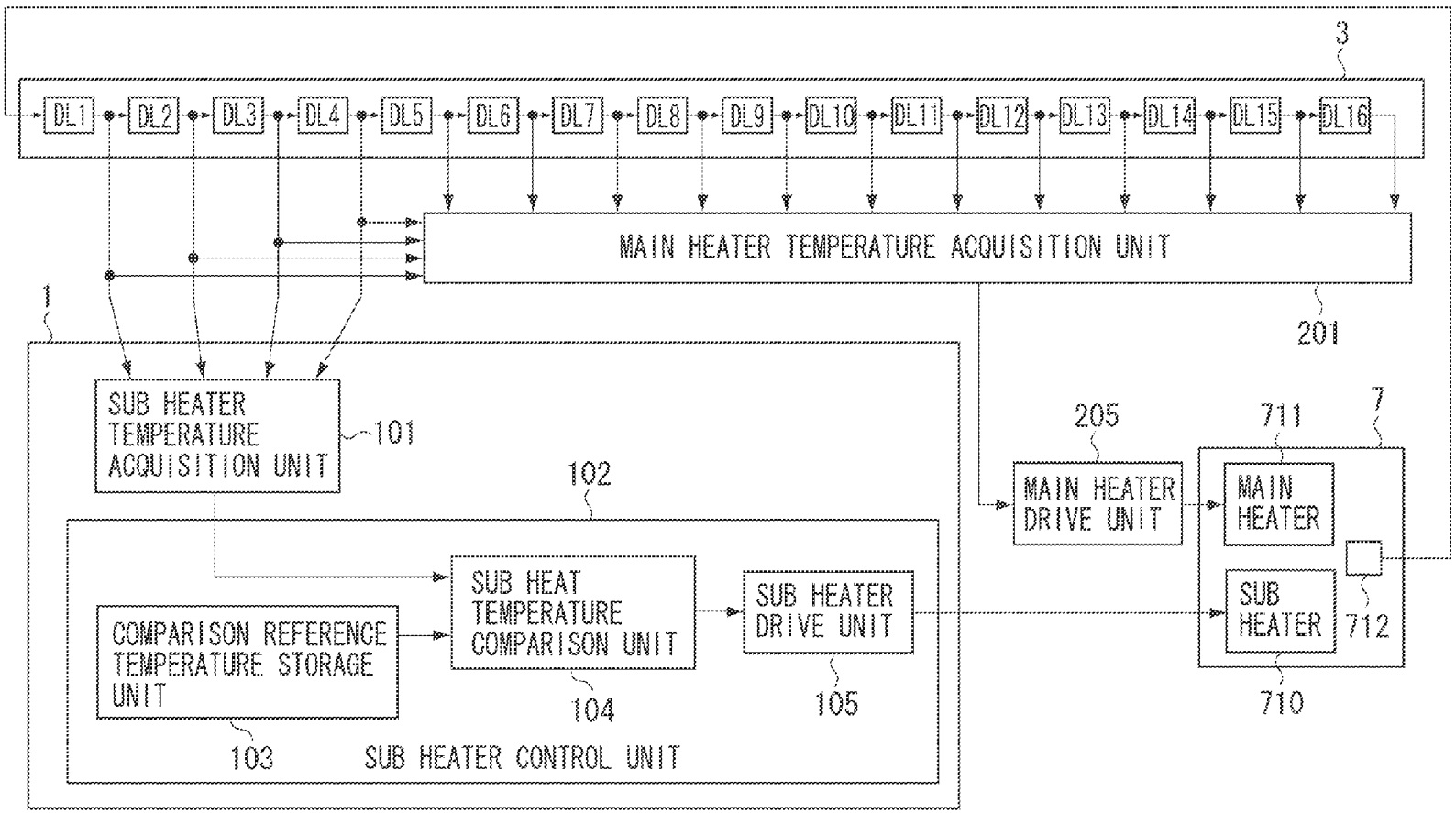
FIG. 2 is a block diagram illustrating in detail the block diagram in FIG. 1.

FIG. 2 illustrates in detail a configuration of the ink-jet recording apparatus. The recording head 7 includes the main heater 711, the sub heater 710, and a temperature sensor 712.

The temperature sensor 712 is a unit for detecting the temperature of the recording head 7 and outputs temperature information indicating the result of detection. The temperature sensor 712 may be, for example, a diode or a temperature variable resister. The main heater 711 is a second heating element for discharging ink. The sub heater 710 is a first heating element for maintaining the temperature of the recording head 7.

FIG. 2 illustrates in detail a configuration of the head temperature storage unit 3. The head temperature storage unit 3 including 16 information storage elements DL1 to DL16 has a structure for sequentially updating the temperature information each time new temperature information is input. The head temperature storage unit 3 stores in the information storage elements DL1 to DL16 respectively 16 pieces of temperature information detected by the temperature sensor 712 in the second period. The 16 pieces of temperature information respectively stored in the information storage elements DL1 to DL16 are output to the main heater control unit 2, and the 4 pieces of temperature information stored in the information storage elements DL1 to DL4 respectively are output to the sub heater control unit 1.

Again, FIG. 1 will be described below. The main heater temperature acquisition unit 201 is a second averaging unit for obtaining the second average temperature at second periods by averaging the temperatures detected by the temperature sensor 712 in the second period. In the present exemplary embodiment, the main heater temperature acquisition unit 201 calculates, at sampling cycles, the moving average of the predetermined number of pieces of temperature information stored in the head temperature storage unit 3. The main heater temperature acquisition unit 201 calculates the moving average based on the predetermined number of pieces of temperature information to acquire the second average temperature information. Thus, the main heater temperature acquisition unit 201 can reduce noise components contained in the temperature information. The second average temperature information is used to determine thermal energy to be applied to ink to be discharged. For example, the second average temperature information is used to determine an ON time duration during which the main heater 711 is turned ON.

The main heater temperature acquisition unit 201 calculates the moving average of, for example, the 16 pieces of temperature information detected by the temperature sensor 712 in the second period. As illustrated in FIG. 2, the main heater temperature acquisition unit 201 averages the 16 pieces of temperature information based on output data from the information storage elements DL1 to DL16. The main heater control unit 2 calculates the moving average <R> of the 16 (n) pieces of temperature information (DLk) based on formula (1).

$$\langle R\rangle=(\Sigma DLk)/n, \text{ where } k=1 \text{ to } n\ (n=16) \quad (1)$$

The main heater temperature acquisition unit 201 outputs the calculated moving average <R> to the main heater control unit 2 as the second average temperature information. Therefore, each time the main heater control unit 2 obtains the second average temperature, it can control the drive of the main heater 711.

When the drive interval of the main heater 711 is larger than the acquisition interval of the second average temperature information, the main heater control unit 2 can control the drive of the main heater 711 based on the latest second average temperature.

The sub heater control unit 1 controls the drive of the sub heater 710 included in the recording head 7. The sub heater control unit 1 includes a sub heater temperature acquisition unit 101 and a sub heater drive control unit 102.

The sub heater temperature acquisition unit 101 is a first averaging unit for obtaining a first average temperature at predetermined periods (hereinafter referred to as first periods) by averaging the temperatures detected by the temperature sensor in the first period. The first period is longer than the sampling period and shorter than the second period.

In the present exemplary embodiment, the sub heater temperature acquisition unit 101 acquires the first average temperature information indicating the first average temperature used to control the sub heater 710. The sub heater temperature acquisition unit 101 calculates at sampling cycles shorter than the first period, the moving average of a number of pieces of temperature information less than the predetermined number stored in the head temperature storage unit 3. The sub heater temperature acquisition unit 101 calculates the moving average based on the predetermined number of pieces of temperature information to acquire the first average temperature information. Thus, the sub heater temperature acquisition unit 101 eliminates noise components contained in the temperature information.

The sub heater temperature acquisition unit 101 receives, for example, the four pieces of temperature information stored in the four information storage elements DL1 to DL4, as illustrated in FIG. 2. The sub heater temperature acquisition unit 101 calculates the moving average based on the four pieces of temperature information detected by the temperature sensor 712 in the first period. For example, the sub heater temperature acquisition unit 101 calculates the moving average <r> of the four (m) pieces of temperature information (DLk) based on formula (2).

$$\langle r\rangle=(\Sigma DLK)/m,\ \text{where } k=1 \text{ to } m\ (m=4) \tag{2}$$

The moving average <r> calculated by formula (2) changes four times faster than the second average temperature acquired by the main heater temperature acquisition unit 201 does. Therefore, the cycle of feedback to the sub heater drive control unit 102 is shortened, making it possible to reduce the temperature error between the target temperature Tav and the actual temperature of the recording head 7. Therefore, the ink-jet recording apparatus can improve the accuracy of the second average temperature information acquired by the main heater temperature acquisition unit 201.

The sub heater temperature acquisition unit 101 outputs to the sub heater drive control unit 102 the result of calculation by formula (2) as the first average temperature information. Although, in the present exemplary embodiment, the number of information storage elements DL1 to DL4 used by the sub heater temperature acquisition unit 101 for the moving average is one quarter of the number of information storage element DL1 to DL16 used by the main heater temperature acquisition unit 201 for the moving average, a similar effect can be obtained if the former number is a half or less than the latter number.

Each time the sub heater temperature acquisition unit 101 obtains the first average temperature, the sub heater drive control unit 102 controls the sub heater drive unit 105 based on the first average temperature acquired by the sub heater temperature acquisition unit 101. In the present exemplary embodiment, the sub heater drive control unit 102 repetitively turns the sub heater 710 ON and OFF so that the first average temperature acquired by the sub heater temperature acquisition unit 101 coincides with the target temperature Tav.

The configuration of the sub heater drive control unit 102 will be described below with reference to FIG. 2. The sub heater drive control unit 102 includes a comparison reference temperature storage unit 103, a sub heat temperature comparison unit 104, and the sub heater drive unit 105. The sub heater drive unit 105 is a first drive unit. The comparison reference temperature storage unit 103 prestores the target temperature Tav for maintaining the temperature of the recording head 7. The sub heat temperature comparison unit 104 compares an output of the sub heater temperature acquisition unit 101 with the target temperature Tav stored in the comparison reference temperature storage unit 103, and outputs a result of comparison to the sub heater drive unit 105.

The sub heater drive unit 105 receives the result of comparison from the sub heat temperature comparison unit 104. According to the result of comparison, the sub heater drive unit 105 outputs drive signals for driving the sub heater 710 to the recording head 7. The sub heater 710 is repetitively turned ON and OFF based on the drive signals output from the sub heater driver unit 105. Upon reception of the result of comparison indicating that the first average temperature is lower than the target temperature Tav, the sub heater drive unit 105 outputs to the sub heater 710 an ON signal for turning ON (heating) the sub heater 710. Otherwise, upon reception of the result of comparison indicating that the first average temperature is higher than the target temperature Tav, the sub heater drive unit 105 outputs to the sub heater 710 an OFF signal for turning OFF (radiating heat from) the sub heater 710.

To suppress chattering produced by the comparison of the first average temperature with the target temperature Tav, the comparison reference temperature storage unit 103 stores a reference value for turning ON the sub heater 710 and another reference value for turning OFF the sub heater 710 as the target temperature Tav.

Figure 3:
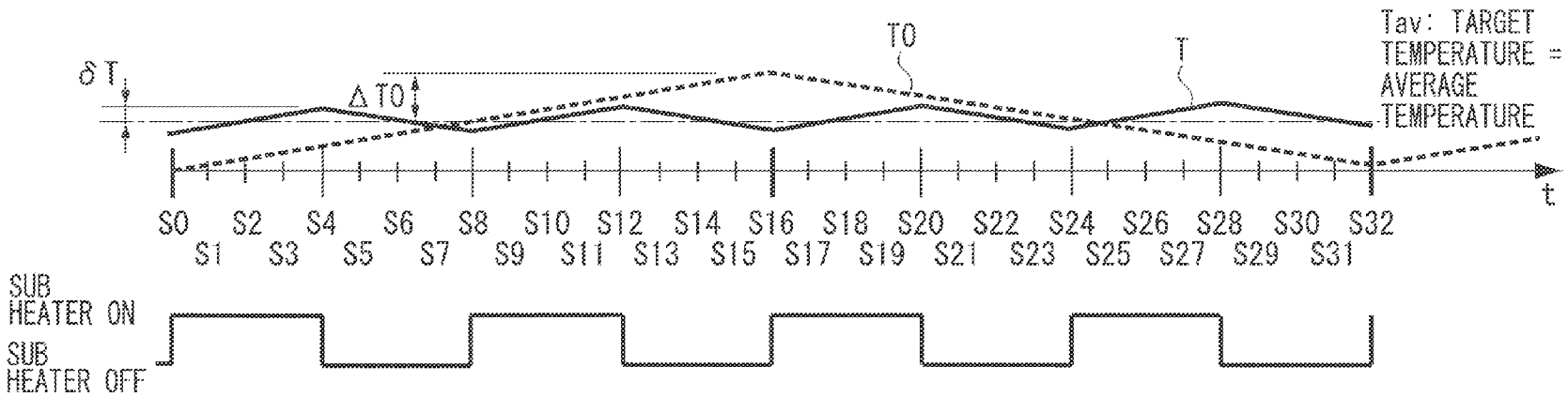
FIG. 3 is a schematic view illustrating temperature changes at a recording head 7.
Figure 7:
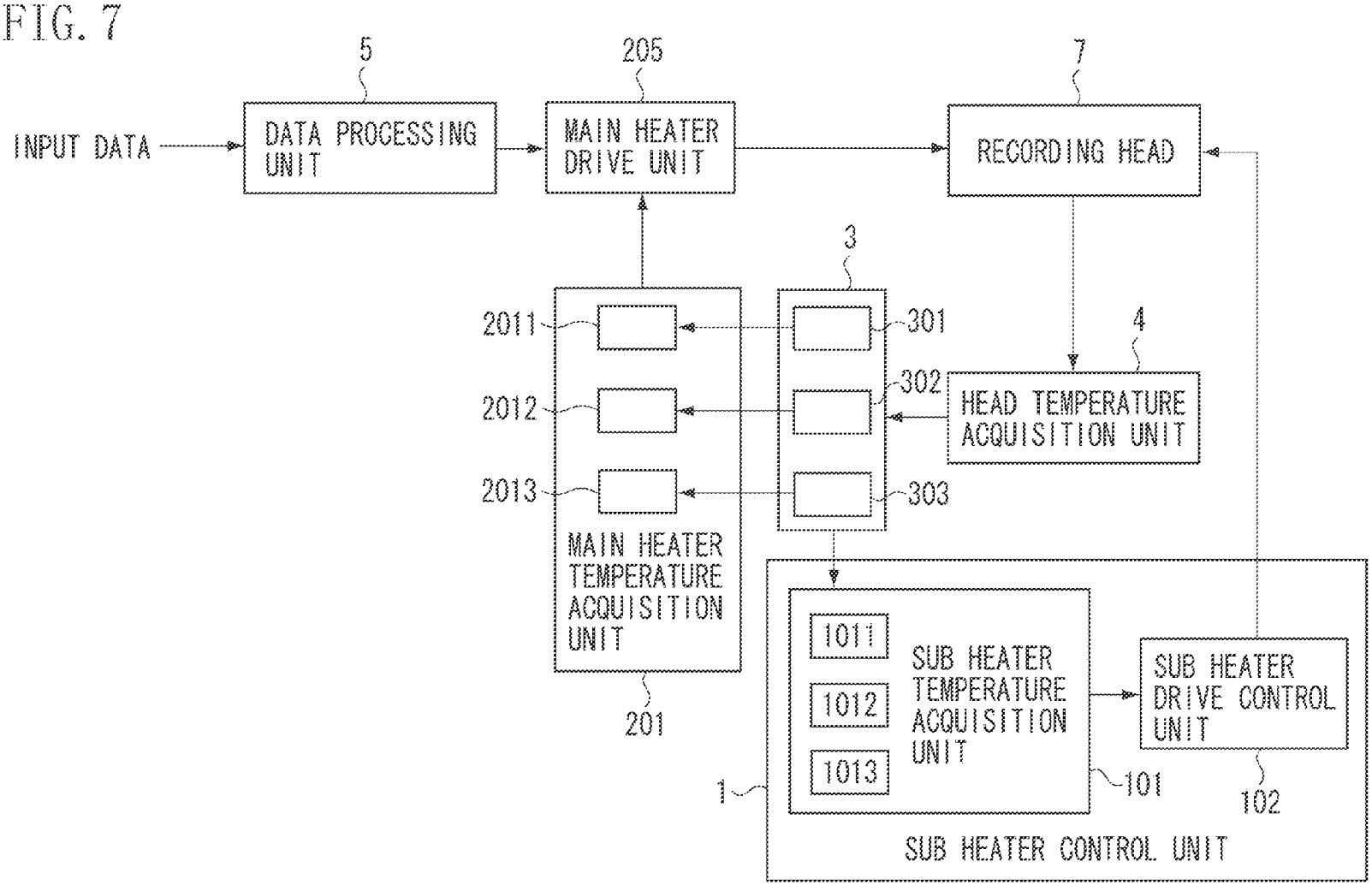
FIG. 7 is a control block diagram illustrating an ink-jet recording apparatus according to the second exemplary embodiment.

FIG. 3 is a schematic view illustrating temperature changes at the recording head 7. Referring to FIG. 3, the actual temperature T of the recording head 7 is illustrated by a solid line, and the temperature T0 illustrated in FIG. 7 is illustrated by a dotted line. Referring to FIG. 3, a temperature sensor detects the four pieces of temperature information in the first period, and the temperature sensor 712 detects 16 pieces of temperature information in the second period. For simplification, the main heater temperature acquisition unit 201 acquires the second average temperature information at second periods, and the sub heater temperature acquisition unit 101 acquires the first average temperature at first periods.

As illustrated in FIG. 3, at the timing S0, since the first average temperature is detected to be lower than a target temperature Tav, the sub heater 710 is turned ON. Therefore, the temperature T begins to rise.

The sub heater temperature acquisition unit 101 acquires the first average temperature information at a timing S4 since the first average temperature is obtained based on the four pieces of temperature information. At the timing S4, since the first average temperature is detected to be higher than the target temperature Tav, the sub heater 710 is turned OFF by a drive signal output from the sub heater drive unit 105. Therefore, from the timing S4 on, the temperature T begins to fall. In the ink-jet printer, the temperature T falls because of the cooling effect by liquid ink itself to be discharged, the heat radiation effect by ink discharge, and the heat radiation effect by a ceramic head support member.

At a timing S8, since the temperature T is detected to be lower than the target temperature Tav, the sub heater 710 is turned ON by a drive signal output from the sub heater drive unit 105. Therefore, the temperature T begins to rise. Thus, the temperature of the recording head 7 enters the equilibrium state.

Although the rate (inclination) of rise and fall in temperature T depends on the heat capacity, the heat radiation characteristics of the object under heat control, and the heating capability of the heating unit, but the rate of rise and fall does not depend on the temperature sampling cycle or period. Therefore, the inclination of rise and fall in temperature T coincides with the inclination of rise and fall in temperature T0.

At a timing S16, the second average temperature information acquired by the main heater temperature acquisition unit 201 is an average of temperatures measured at the timings S1 to S16, which is almost equal to the target temperature Tav. This results in a temperature error δT from the target temperature Tav in the equilibrium state. This temperature error δT is smaller than the temperature error ΔT illustrated in FIG. 7. Therefore, in the ink-jet recording apparatus in the present exemplary embodiment, the temperature error between the second average temperature acquired by the main heater temperature acquisition unit 201 and the actual temperature illustrated in FIG. 7 is smaller than that of the ink-jet recording apparatus. Thus, fluctuations in discharge characteristics of the recording head 7 due to the temperature error can be suppressed.

To facilitate understanding, the schematic view in FIG. 3 has been described based on a case where the first average temperature information acquired by the sub heater temperature acquisition unit 101 is calculated at a cycle during which all of the four pieces of temperature information are replaced. In the present exemplary embodiment, since calculation is performed based on the moving average, feedback to the sub heater drive control unit 102 can be performed at sampling cycles at which temperature information is acquired by the recording head temperature acquisition unit 4. This enables the sub heater drive control unit 102 to control the sub heater 710 more finely.

Likewise, the second average temperature information is also acquired based on the moving average and therefore the second average temperature information is output to the main heater control unit 2 at sampling cycles at which temperature information is acquired by the recording head temperature acquisition unit 4. This enables the main heater control unit 2 to control the main heater 711 more finely.

A timing at which temperature information is acquired by the recording head temperature acquisition unit 4 will be briefly described below with reference to FIG. 4.

Figure 4:
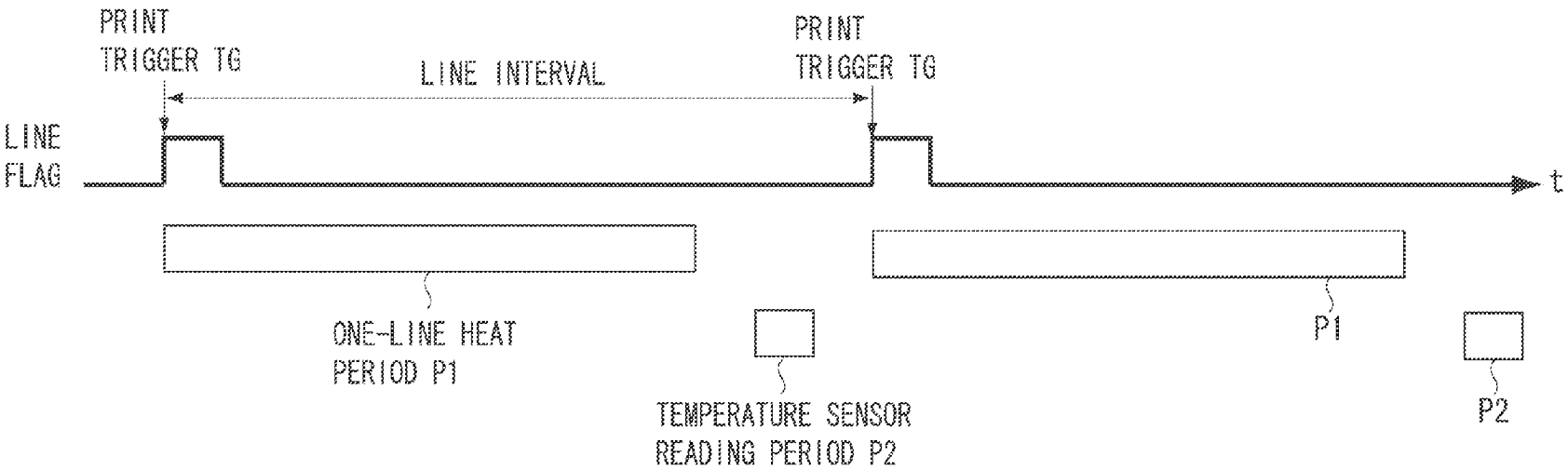
FIG. 4 is a conceptual diagram illustrating a temperature acquisition timing of the recording head 7.

FIG. 4 is a conceptual diagram illustrating an example of acquiring the temperature of the recording head 7 with reference to a line flag signal. FIG. 4 illustrates the line flag signal, a one-line heating period P1, and a temperature sensor reading period P2. The horizontal axis is assigned time.

The line flag signal is a reference signal corresponding to one line (one raster) to be printed by the recording head 7. The line flag signal is generated by the reference signal generation unit 8 (illustrated in FIG. 1).

In the one-line heating period P1, the ink-jet header 7 is driven according to a print trigger (rising edge of the line flag) TG to print the print data for one line. The one-line heating period P1 is a time period shorter than the line interval.

In the temperature sensor reading period P2, the recording head temperature acquisition unit 4 reads temperature information from the temperature sensor. The temperature sensor reading period P2 is set to a timing other than the one-line heating period P1 so that the two periods P1 and P2 do not overlap with each other.

Therefore, the ink-jet recording apparatus acquires temperature information at a fixed timing after the one-line heating period P1, thus reducing the influence by heating of the main heater 711. Further, the ink-jet recording apparatus can acquire temperature information for each line (at line cycles) during printing on a print sheet.

According to the first exemplary embodiment of the present invention, at second periods, the main heater temperature acquisition unit 2012 (second averaging unit) averages the temperatures detected by the temperature sensor in the second period to obtain the second average temperature. Then, each time the main heater temperature acquisition unit 201 obtains the second average temperature, the main heater drive unit 205 (second drive unit) drives the main heater 711 (second heating element) based on the second average temperature. At first periods shorter than the second period, the sub heater temperature acquisition unit 101 (first averaging method) averages the temperatures detected by the temperature sensors in the first period to obtain the first average temperature. Each time the sub heater temperature acquisition unit 101 obtains the first average temperature, the sub heater drive control unit 102 (first drive unit) drives the sub heater 710 (first heating element) based on the first average temperature acquired by the sub heater temperature acquisition unit 101.

Therefore, with the ink-jet recording apparatus according to the present exemplary embodiment, the cycle at which the sub heater temperature acquisition unit 101 obtains the first average temperature can be shorter than the cycle at which the main heater temperature acquisition unit 201 obtains the second average temperature. Specifically, since the sub heater drive control unit 102 can repetitively turns the sub heater 710 ON and OFF at shorter cycles, temperature fluctuations at the recording head 7 can be reduced. Therefore, the ink-jet recording apparatus can stabilize the second average temperature to be supplied to the recording head drive unit 6.

According to the first exemplary embodiment of the present invention, the ink-jet recording apparatus can improve the stability of the ink discharge characteristics of the recording head 7, enabling more preferable printing.

In the first exemplary embodiment of the present invention, the sub heater temperature acquisition unit 101 (first averaging unit) calculates in a time period shorter than the first period the moving average of the temperatures detected by the temperature sensor in the first period. Therefore, the sub heater drive control unit 102 can control ON/OFF changeover of the sub heater 710 still more finely.

In the first exemplary embodiment of the present invention, the main heater temperature acquisition unit 201 (second averaging unit) calculates in a time period shorter than the second period the moving average of the temperatures detected by the temperature sensor in the second period. Therefore, the recording head drive unit 6 can perform discharge control of the recording head 7 with still higher accuracy.

The main heater drive unit 205 performs discharge control of the recording head 7 based on the second average temperature information acquired by the main heater temperature acquisition unit 201 in addition to the first average temperature information acquired by the sub heater temperature acquisition unit 101. This means that the recording head 7 can be driven preferably even when the range of recording head temperature control by the sub heater 710 deviates from the target temperature Tav.

For example, when printing dark images in succession, a large amount of discharge from the recording head 7 increases the amount of heating for ink discharge by the main heater 711, causing temperature rise at the recording head 7 exceeding the target temperature Tav. In this case, although the sub heater control unit 101 automatically turns OFF the sub heater 710, deviation from the target temperature Tav will persist for a while since the recording head 7 radiates a fixed amount of heat. Even in this case, the main heater drive unit 205 can drive the main heater 711 based on the second average temperature information acquired by the main heater temperature acquisition unit 201 independently of control of the sub heater 710 by the sub heater control unit 1.

As mentioned above, the sub heater control unit 1 can control the drive of the sub heater 710 independently of the main heater drive unit 205. Therefore, it is not necessary to control ON/OFF changeover of the sub heater 710 with reference to the timing of head discharge control. Therefore, the sub heater control unit 1 can be implemented with a simple circuit configuration.

For example, before starting printing, since the main heater 711 of the recording head 7 is not heated by the recording head drive unit 6, the sub heater 710 is turned ON and then the temperature of the recording head 7 reaches the target temperature Tav. When the temperature of the recording head 7 reaches the target temperature Tav, the sub heater 710 is turned OFF so that the temperature automatically falls within the predetermined temperature range. When printing is started, since temperature rise occurs at the recording head 7 owing to heating by the main heater 711, the sub heater 710 is automatically turned OFF. During printing, even when a print pattern changes and the amount of heat of the main heater 711 decreases, some of the sub heaters 710 are automatically turned ON. This suppresses temperature changes at the recording head 7, thus enabling preferable head drive control.

The timing of ON/OFF changeover of the sub heater 710 by the sub heater control unit 1 is set after the temperature sensor reading period P2 illustrated in FIG. 3 before the next one-line heating period P1. This aims to prevent fluctuations in temperature characteristics during printing of one line when the sub heater 710 is turned ON and OFF in the one-line heating period P1.

Figure 5A:
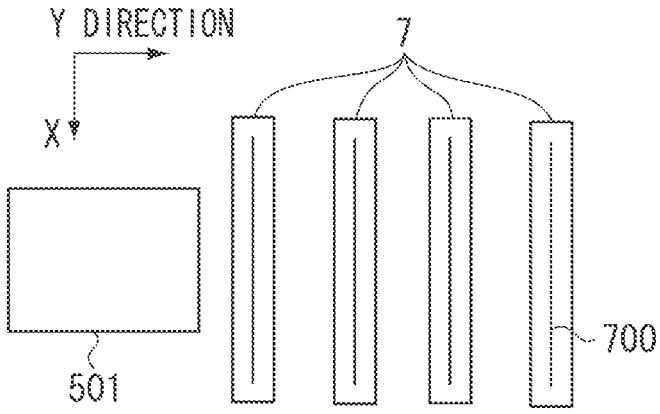
FIGS. 5A and 5B are schematic views illustrating the ink-jet recording apparatus according to the present invention.
Figure 5B:
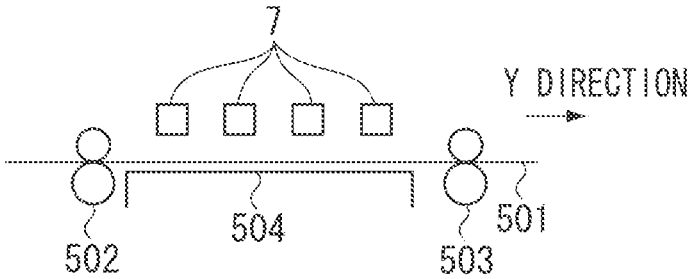

The ink-jet recording apparatus will be described below. FIG. 5A is a schematic plan view illustrating the ink-jet recording apparatus, and FIG. 5B is a schematic cross sectional view illustrating the ink-jet recording apparatus. Four recording heads 7 are arranged in the conveyance direction (Y direction) of a sheet (recording medium) 501. A plurality of nozzle are arranged in the X direction. Each of the four recording head 7 includes a plurality of nozzle arrays 700 arranged in linear form. The main heater 711 is provided for each nozzle. Conveyance roller pairs 502 and 503 convey the sheet 501 in the Y direction. The nozzles 700 discharge ink onto the sheet 501 being conveyed on a platen 504.

An ink-jet recording apparatus according to a second exemplary embodiment will be described below.

Figure 6:
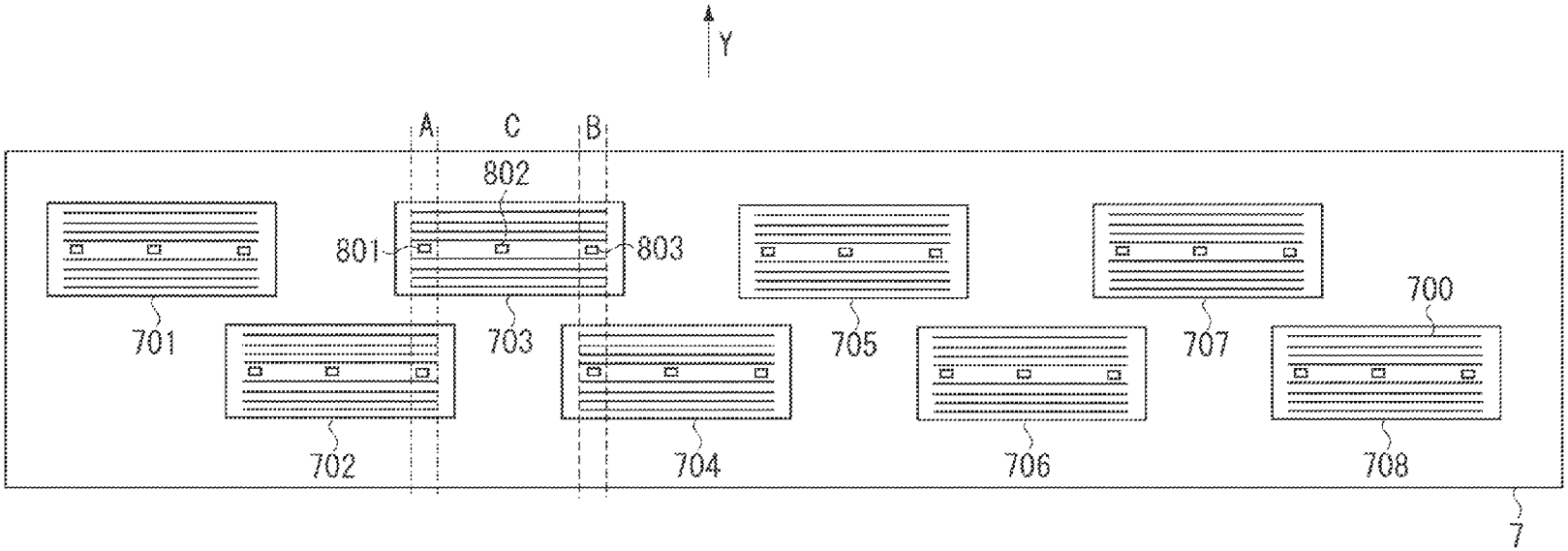
FIG. 6 is a schematic view illustrating an exemplary configuration of the recording head 7 according to a second exemplary embodiment.

FIG. 6 is a schematic view illustrating an exemplary configuration of the recording head 7 in the second exemplary embodiment. Referring to FIG. 6, the recording head 7 includes a plurality of subunits 701 to 708 each being provided with a plurality of temperature sensors. Eight lines 700 illustrated in each of the subunits 701 to 708 indicate nozzle arrays provided in linear form. Each Nozzle array includes a plurality of nozzle. The nozzle arrays are formed so as to place ink at almost the same position on a recording medium (print sheet).

Specifically, overlapping portions at both ends of each of the subunits 701 to 708 (for example, ends A and B of the unit 703) are formed so as to place ink at almost the same position on the recording medium. Square marks (□) illustrated in each of the subunits 701 to 708 indicate temperature sensors. For example, temperature sensors 801 to 803 are illustrated in the unit 703. The temperature sensors 801 and 803 are a first detection unit for detecting the temperature in predetermined areas A and B of the recording head 7. The temperature sensor 802 is a second detection unit for detecting the temperature of an area C outside the predetermined areas A and B.

Each of the subunits 701 to 708 is arranged so as to partially overlap with portions of other subunits in the conveyance direction of the print sheet. Of the three temperature sensors provided for each of the subunits 701 to 708, one of them is provided at the center portion (for example, in the area C) to detect the temperature of a non-overlapping portion, and two of them are provided at both ends (for example, in the areas A and B) to detect the temperature of overlapping portions.

Both ends of the subunits 701 to 708 are overlapping with ends of other subunits in the conveyance direction and therefore can be provided with double number of nozzles that can place ink at almost the same position in comparison with the center portion of the subunits 701 to 708. Accordingly, both ends have a one-half frequency of ink discharge in comparison with the center portion. Therefore, specifically, both ends (for example, the areas A and B) of the subunits 701 to 708 have a lower rate in temperature rise at the recording head 7 heated by the main heater 711 than the center portion (for example, the area C) of the subunits 701 to 708.

In the second exemplary embodiment, therefore, the main heater temperature acquisition unit 201 can supply to the main heater drive unit 205 the second average temperature information for each of the three areas (for example, the areas A, B, and C) of the subunits 701 to 708. The sub heater 710 is provided for each of the subunits 701 to 708 so that the each subunit can be entirely warmed.

FIG. 7 is a control block diagram illustrating the ink-jet recording apparatus having the recording head 7 illustrated in FIG. 6. FIG. 7 illustrates an exemplary configuration of the ink-jet recording apparatus, focusing on one subunit 703 out of the subunits 701 to 708 each having three temperature sensors.

The head temperature acquisition unit 4 acquires the temperatures detected by the temperature sensors 801 to 803 at sampling cycles. The head temperature acquisition unit 4 stores in the subunits 301 to 303 temperature information indicating the temperatures detected by the temperature sensors 801 to 803, respectively.

The head temperature storage unit 3 includes the subunits 301 to 303 corresponding to the three temperature sensors 801 to 803, respectively. Each of the subunits 301 to 303 has a similar configuration to the head temperature storage unit 3 illustrated in FIGS. 1 and 2. The output of the subunits 301, 302, and 303 is represented as, for example, aDLn, where a=301, 302, and 303, respectively, and n=1 to 16.

The main heater temperature acquisition unit 201 includes subunits 2011 to 2013 corresponding to the three temperature sensors 801 to 803. The subunits 2011 to 2013 have a similar configuration to the main heater temperature acquisition unit 201 illustrated in FIGS. 1 and 2. The subunits 2011 and 2013 are first calculation units for obtaining a first detection temperature at second periods by averaging the temperatures detected by the temperature sensors 801 and 803 in the second period. The subunit 2012 is a second calculation unit for obtaining a second detection temperature at second periods by averaging the temperatures detected by the temperature sensor 802 in the second period. The output of the subunits 2011, 2012, and 2013 is represented as, for example, <aR>, where a=301, 302, and 303, respectively.

Similar to formula (1), the subunits 2011, 2012, and 2013 calculate the second average temperature <aR> based on the following formula: $\langle aR\rangle=(\Sigma aDLk)/m$, where a=301, 302, and 303, respectively, and k=1 to m (m=16).

Each time the subunits 2011 to 2013 obtain the first and second detection temperatures, the main heater drive unit 205 drives the main heater 711 based on the first and second detection temperatures obtained by the subunits 2011 to 2013. In the present exemplary embodiment, each time the second average temperature is output from the subunits 2011 to 2013, the main heater drive unit 205 controls the main heater 711 corresponding to the areas A, B, and C of the recording head 7 based on these results.

The sub heater temperature acquisition unit 101 includes subunits 1011 to 1013 corresponding to the three temperature sensors 801 to 803. The subunits 1011 to 1013 have a similar configuration to the sub heater temperature acquisition unit 101 illustrated in FIGS. 1 and 2. Each piece of first average temperature information <ar> acquired by the subunits 1011, 1012, and 1013 is represented as, for example, <ar>, where a=301, 302, and 303, respectively.

Similar to formula (2), the sub heater temperature acquisition unit 101 calculates the first average temperature information <ar> based on the following formula: <ar>=(ΣaDLk)/m, where a=301, 302, and 303, and k=1 to m (m=4).

The sub heater drive control unit 102 has a similar configuration to the sub heater drive control unit 102 illustrated in FIG. 2. Therefore, descriptions of the sub heater drive control unit 102 will be omitted. The sub heater drive control unit 102 calculates an average value of the three pieces of first average temperature information respectively acquired by the subunits 1011 to 1013, compares the average value with the target temperature Tav, and drives the sub heater drive unit 105 based on the result of comparison.

The sub heat temperature comparison unit 104 calculates an average value <r3> of three outputs of the sub heater temperature acquisition unit 101 based on the following formula: <r3>=(Σ(<ar>))/3, where a=301, 302, and 303.

The sub heat temperature comparison unit 104 compares the calculated average value <r3> with the target temperature Tav. When the circuit configuration becomes complicated because of 3 (odd number), the sub heat temperature comparison unit 104 (not illustrated) may compare a value which is three times the target temperature Tav stored in the comparison reference temperature storage unit 103 (not illustrated) with the result of calculation <r3>=Σ(<ar>).

According to the second exemplary embodiment of the present invention, the temperature sensor 801 (first detection unit) detects the temperature of the area A of the subunit 703, and the temperature sensor 802 (second detection) detects the temperature of the area C of the subunit 703. At second periods, the subunit 2011 (first calculation unit) averages the temperatures detected by the temperature sensor 801 in the second period to obtain the first detection temperature. At second periods, the subunit 2012 (second calculation unit) averages the temperatures detected by the temperature sensor 802 in the second period to obtain the second detection temperature. Each time the subunits 2011 and 2012 obtain the first and second detection temperatures, the main heater drive unit 205 (second drive unit) drives the main heater 711 based on the first and second detection temperatures obtained by the subunits 2011 and 2012.

Therefore, the main heater drive unit 205 can perform discharge control of the recording head 7 for each of the areas A and C having different temperature characteristics of the recording head 7 depending on a relative difference in amount of discharge of ink in the recording head 7.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-100043 filed Apr. 23, 2010, which is hereby incorporated by reference herein in its entirety.

What is claimed is:

1. A recording apparatus comprising:

a recording head configured to discharge ink;

a temperature detection unit configured to detect a temperature of the recording head;

a first heating element configured to maintain the temperature of the recording head and a second heating element configured to discharge the ink, disposed at the recording head;

an acquisition unit configured to acquire at a plurality of predetermined intervals the temperature detected by the temperature detection unit;

a first averaging unit configured to obtain an average temperature based on the temperatures acquired by the acquisition unit in a first period;

a first drive unit configured to drive the first heating element based on the average temperature obtained by the first averaging unit;

a second averaging unit configured to obtain an average temperature based on the temperatures acquired by the acquisition unit in a second period including the first period and longer than the first period; and a second drive unit configured to drive the second heating element based on the average temperature obtained by the second averaging unit.

2. A recording apparatus comprising:

a recording head for discharging ink;

a temperature detection unit configured to detect a temperature of the recording head at a plurality of timings set at predetermined intervals in a first period;

a first heating element configured to maintain the temperature of the recording head, and a second heating element configured to discharge the ink, disposed at the recording head;

a first averaging unit configured to obtain a first average temperature by averaging the temperatures detected by the temperature detection unit at the plurality of timings set at the predetermined intervals in the first period;

a first drive unit configured to drive the first heating element based on the first average temperature;

a second averaging unit configured to obtain a second average temperature by averaging the temperatures detected by the temperature detection unit at a plurality of timings set at predetermined intervals in a second period including the first period and longer than the first period; and a second drive unit configured to drive the second heating element based on the second average temperature.

3. The recording apparatus according to claim 2, wherein the first averaging unit calculates in a cycle shorter than the first period the moving average of the temperatures detected by the temperature detection unit in the first period.

4. The recording apparatus according to claim 2, wherein the second averaging unit calculates in a cycle shorter than the second period the moving average of the temperatures detected by the temperature detection unit in the second period.

* * * * *